United States Patent [19]

Elliott, Jr. et al.

[11] Patent Number: 4,929,339

[45] Date of Patent: May 29, 1990

[54] METHOD FOR EXTENDED CONDITIONING OF DELAYED COKE

[75] Inventors: John D. Elliott, Jr., Randolph, N.J.; Robert DeBiase, Staten Island, N.Y.

[73] Assignee: Foster Wheeler U.S.A. Corporation, Clinton, N.J.

[21] Appl. No.: 784,950

[22] Filed: Oct. 7, 1985

Related U.S. Application Data

[63] Continuation-in-part of Ser. No. 588,635, Mar. 12, 1984, abandoned.

[51] Int. Cl.[5] ..... C10G 9/14

[52] U.S. Cl. ..... 208/131; 201/29

[58] Field of Search ..... 201/2, 25, 29, 44; 208/50, 53, 78, 131

[56] References Cited

U.S. PATENT DOCUMENTS

| | | | |
|---|---|---|---|
| 2,775,549 | 12/1956 | Shea, Jr. | 208/131 |
| 3,344,057 | 9/1967 | Patrick | 208/50 |
| 3,389,074 | 6/1968 | Biehl | 208/53 |
| 3,472,761 | 10/1969 | Cameron | 208/131 |
| 3,745,110 | 7/1973 | Allred | 208/131 |
| 3,936,358 | 2/1976 | Little | 201/39 |
| 3,956,101 | 5/1976 | Hara et al. | 208/50 |
| 3,959,115 | 5/1976 | Hayashi et al. | 208/131 |
| 4,049,538 | 9/1977 | Hayashi et al. | 208/50 |
| 4,066,532 | 1/1973 | Garcia | 208/131 |
| 4,219,405 | 8/1980 | Pietzka et al. | 208/50 |

*Primary Examiner*—Joye Woodard

*Attorney, Agent, or Firm*—Marvin A. Naigur

[57] ABSTRACT

A method for conditioning delayed coke includes allowing coke to form in a first chamber or coke drum, while simultaneously conditioning coke in a second coke drum by flowing through it a hydrocarbon conditioning fluid recirculated from another portion of the coking apparatus, said conditioning fluid having a temperature of more than 750° F. and less than 1000° F., and decoking a third coke drum. The coking, conditioning and decoding operations are sequentially switched among the coke drums.

8 Claims, 2 Drawing Sheets

METHOD FOR EXTENDED CONDITIONING OF DELAYED COKE

This is a continuation-in-part of Ser. No. 588,635, filed on Mar. 12, 1984, now abandoned.

DESCRIPTION

Background of the Invention

In the production of anisotropic coke, commonly known as needle coke, in the delayed coking process, it is common practice to condition the coke formed in the reaction chamber or coke drum by one of several methods. These are (1) raising the drum temperature while the coke is forming, especially during the latter stages of the coke formation; (2) after the coke is formed, by shutting off the fresh feed portion of the charge to the coke drum and recycling coker products or a portion thereof as a hot vapor through the already formed mass of coke; and (3) holding the already formed coke at a temperature above 750 degrees Fahrenheit. The above procedures, known as "temperature soaking" or "drying out" of the coke, are employed to condition or improve specific properties of the anisotropic coke. The improved properties include (1) lower volatile matter content, (2) increased hardness, and (3) increased crystallinity, resulting in a lower coefficient of thermal expansion.

In general practice, the amount of in situ coke conditioning is limited by the sizing of the drum to meet process unit capacity requirements. Since the drum must be fully decoked and prepared to receive feedstock within a fixed operating cycle, the time usually allowed for coke conditioning is typically less than 8 hours. Thus, the amount by which specific properties of the coke can be improved is limited.

Furthermore, in known delayed coking processes, fluids having temperatures of 1000° F. or greater have been passed through the coke, which is unnecessarily high for maintaining the temperature of the formed coke at a temperature above 750° F. and, therefore, constitutes a waste of energy in excessively heating the fluids. Moreover, steam has been used as the fluid passed through the coke, and the use of steam involves additional energy and equipment to heat the steam, as well as to condense it and clean it before discharging it to the environment.

SUMMARY OF THE INVENTION

It is, therefore, an object of the present invention to permit extended conditioning of coke.

It is a further object of the invention to extend the conditioning without interrupting the coking process.

It is another object of the invention to obtain optimum conditioning of the coke by passing conditioning fluid through the coke drum at a temperature above 750° F. and below 1000° F. and by using as conditioning fluid hot streams of hydrocarbon fluids already present in a delayed coking system.

In order to achieve these and other objects, the method according to the present invention utilizes additional reaction chambers or coke drums to permit extending the allotted time for conditioning of the coke and, thus, permits greater improvement in the properties of the coke. For example, if the desired quantity of coke conventionally requires a two coke drum process unit employing an overall cycle of 48 hours for each drum, the use of a third drum permits extended conditioning of the coke. In the conventional process unit, each drum is employed sequentially and alternately for 24 hours of coke formation and 24 hours conditioning and decoking. In the present invention, the third drum sized identically to the other two permits each drum to operate sequentially and alternately in the following mode: (1) 24 hours coke formation, (2) 24 hours conditioning and (3) 24 hours decoking. Each of these time allotments can be varied to achieve desired requirements of process capacity, cycle time and product improvement. When each or any of the three portions of the overall cycle described above is decreased, the required size of the coke drum can also be decreased by an appropriate amount resulting from the number or fractional number of coking formation segments permitted by the overall cycle. In the example given above, if each segment were operated for 18 hours instead of 24 hours, the coke drums could be sized at 75 percent of the capacity required for the 24 hour cycles. Alternatively, if each drum were capable of holding the coke formed in 24 hours of operation, the overall unit production of coke could be increased by one-third if each of the 3 operations were reduced to 18 hours from 24 hours.

In addition, in the method according to the present invention, the coke is conditioned by fluids having a temperature above 750° F. and below 1000° F., so that the coke already formed is maintained above 750° F. to accomplish the conditioning, while excessive heating of the conditioning fluids and the associated waste of fuel and money are avoided. Furthermore, hot streams of fluids already present in the delayed coking system are used as the conditioning fluids. Such streams require only minimal additional energy input to raise their temperature to the desired range of greater than 750° F. and less than 1000° F., and, after passing through the coke to condition it, the streams can be recirculated to the coker fractionator, which is an essential element in a delayed coking process, without requiring any separate or additional treatment.

DETAILED DESCRIPTION OF THE PREFERRED EMBODIMENT

Figure 1:
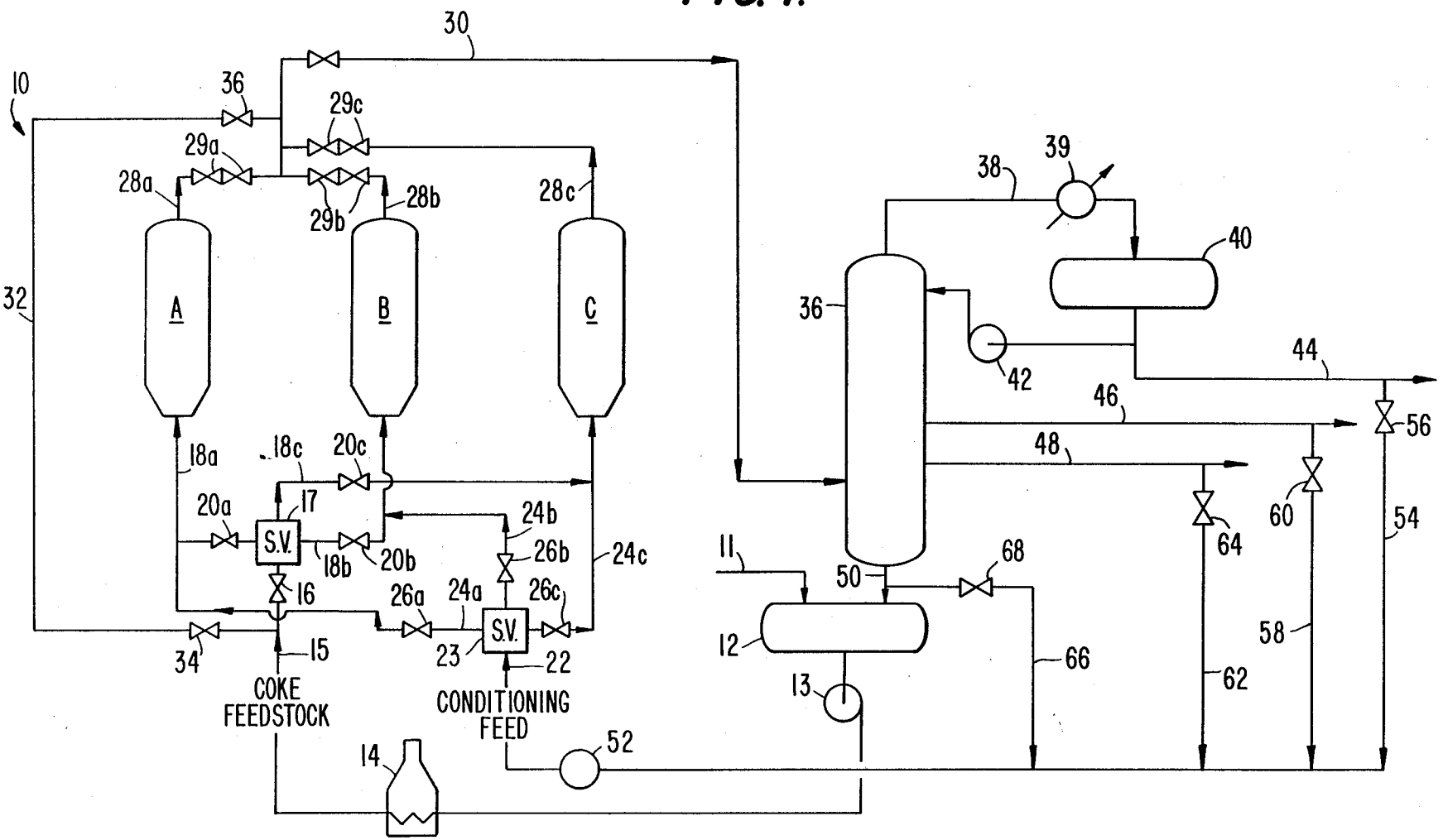
FIG. 1 is a schematic representation of a delayed coking system including three coke drums, a fractionator and appropriate piping for use in connection with the process according to the present invention.

As can be seen from FIG. 1, the reference numeral 10 generally indicates apparatus for use in connection with the coking process according to the present invention. A fresh feed line 11 provides coke feedstock to the coking process from a source, such as the residual bottoms from a refining process, through a heater surge drum 12, a pump 13 and a heater 14, from which the feedstock is discharged after being heated typically to a temperature of about 900° F.–1000° F. An inlet line 15 receives such a discharge and directs it through a main inlet valve 16 to a multi-position switch valve 17 which directs the flow of the coke feedstock to one of a plurality of connecting lines **18*a*, 18*b* or 18*c*. The connecting lines connect the valve 17 to conditioning chambers or coke drums A, B and C, respectively. Valves 20***a*, 20*b* and 20*c* are positioned in the connecting lines to isolate the flow therethrough. A conditioning feed inlet line 22 is provided to direct hot conditioning hydrocarbon fluid from another portion of the coking apparatus 10, as will be described hereinafter, as hot vapor to the coke drums A, B and C through a switch valve 23 and connecting lines 24*a*, 24*b* and 24*c* respectively. The conditioning fluid improves the coke by stripping residual hydrocarbon tar and lowering volatile matter content of the coke, increasing its hardness, and increasing its crystallinity, which lowers its coefficient of thermal expansion.

Isolation valves 26*a*, 26*b* and 26*c* are provided in the connecting lines 24*a–c*, respectively. Outlet lines 28*a*, 28*b* and 28*c* extend from the coke drums A, B and C to permit the removal of light products from the coking process, thereby leaving only coke in the coke drums. The outlets 28*a*, 28*b* and 28*c* are connected to a common delivery line 30 through pairs of isolation valves 29*a*, 29*b* and 29*c*, the isolation valves being employed in pairs to account for valve leakage. A warm-up line 32 is connected directly from the coke feed-stock inlet 15 to the delivery line 30, and flow therethrough is controlled by valves 34 and 36. During start up of the apparatus 10, before coke feedstock is fed to any of the coke drums, the hot vapors of the feedstock are allowed to flow into one of the coke drums A, B or C through its respective outlet line 28*a*, *b* or *c* to preheat the coke drum and, thereby, to avoid the thermal shock that can result if the hot feedstock is fed to a drum which is at ambient temperatures.

In operation, the main inlet valve 16 is opened to allow the flow of coke feedstock through the inlet line 15 to the switch valve 17. The switch valve 17 directs the flow to one of the three coke drums, for example, coke drum A, through the associated valve, in this case valve 20*a* and prevents the flow of feedstock to any other drum. When the coke drum A is full of coke, the valve 20*b* controlling the flow of feedstock to coke drum B is opened, the switch valve 17 is operated to direct the incoming feedstock through the line 18*b* and the valve 20*b*, and the valve 20*a* controlling the flow to the coke drum A is closed. When coke drum B is full of coke, the valve 20*c* is opened, the switch valve 17 is operated to direct the flow of feedstock through the line 18*c*, and the valve 20*b* is closed. When the coking operation in coke drum C is completed, the same operation takes place with respect to coke drum A. The switch valve 17 may be operated manually or automatically.

While the coking operation is taking place in drum A, coke which has already formed in drum C is being conditioned by the flow of a stream of hot conditioning hydrocarbon fluid from another portion of the coking apparatus 10. The conditioning fluid strips unreacted hydrocarbons from the coke and maintains the coke at a temperature of more than 750° F. Without the flow of the conditioning material or the application of heat from some other source, the temperature of the coke would fall rapidly. Thus, the feed of conditioning fluid through the inlet line 22 to the switch valve 23 is directed by the switch valve 23 through the isolation valve 26*c* and the connecting line 24*c* to the coke drum C. When the conditioning of the coke in coke drum C is complete, the switch valve 23 is moved to a position in which the flow of conditioning fluid is directed to coke drum A. Similarly, when the conditioning of the coke in coke drum A is completed, the switch valve 23 can be operated to direct the flow of conditioning fluid to coke drum B. The switch valve 23 may be operated manually or automatically.

While coke is being allowed to form in coke drum A and conditioned in coke drum C, coke drum B can be decoked. Decoking involves the removal of the coke from the drum, such as by the use of high impact water jets to hydraulically bore and cut the coke.

Figure 2A:
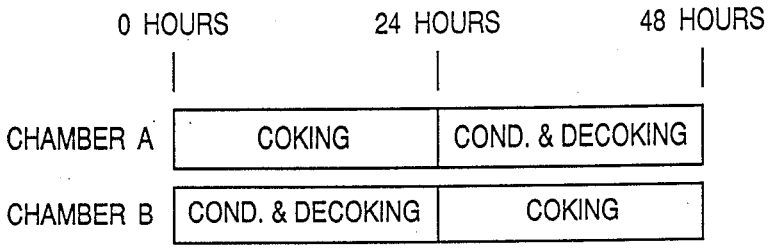
FIG. 2A. (PRIOR ART)
FIG. 2A is a representation of a prior art coking cycle.

In a conventional coking process, as can be seen from FIG. 2A, only two conditioning chambers or coke drums A and B are employed, and the coke forming process, including the feeding of the coke feedstock to the coke drum, occurs in one coke drum, while conditioning and decoking take place in the other drum. Thus, in a typical 48 hour cycle, coking takes place for approximately 24 hours and conditioning and decoking combined take place for 24 hours. As a result, the time available for conditioning is typically less than 8 hours.

Figure 2B:
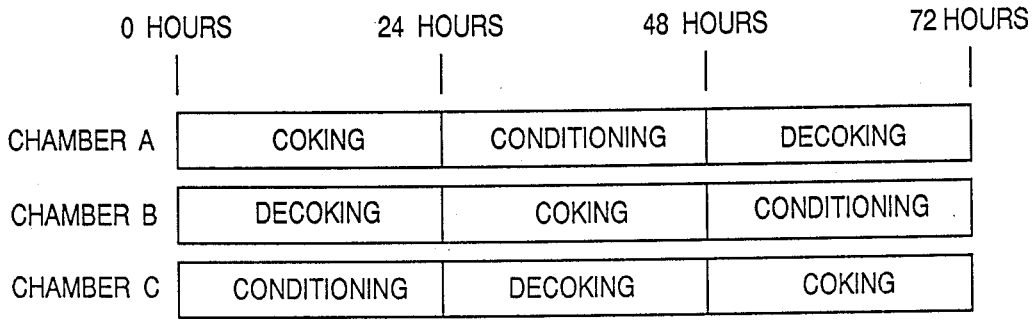
FIG. 2B is an illustration of an exemplary coking cycle for the process according to the present invention.
Figure 2C:
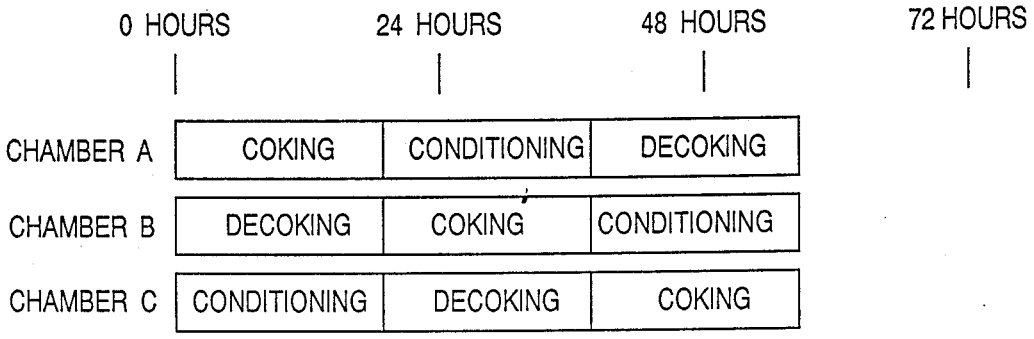
FIG. 2C is a schematic representation of an alternate coking cycle according to the present invention.

As can be seen from FIGS. 2B and 2C, the use of an additional coke drum, drum C, in connection with the process according to the present invention, permits a much greater conditioning time. For example, in the exemplary 72 hour cycle illustrated in FIG. 2B, coking or coke formation is allowed to occur for 24 hours, as it was in the prior art process. However, conditioning and decoking are each able to last for a 24 hour period. The same amount of conditioned coke is delivered from the process of FIG. 2B as was delivered from the process of FIG. 2A, but a much greater conditioning time is available.

In the process of FIG. 2B, the allowing of the coke to form in coke drum A, including the feeding of the coke feedstock to the chamber, is simultaneous, for the same 24 hour period, with the decoking of coke drum B and the conditioning of the coke in coke drum C to improve one or more of its properties. Similarly, the conditioning of the coke in coke drum A is simultaneous for a 24 hour period with the coking in coke drum B and the decoking of coke drum C; and the decoking of coke drum A is simultaneous with the conditioning of coke drum B and the coking in coke drum C.

As can be seen from FIG. 2C, the overall operating cycle of the process according to the present invention can be reduced, for example, to 54 hours and, thus, provide a greater output of conditioned coke than was possible with the prior art system. In the example of FIG. 2C, the coking period is reduced from 24 hours to approximately 18 hours, as are the conditioning and decoking periods. However, the 18 hours provided for the conditioning period is still 225% greater than the 8 hours maximum available for conditioning in accordance with the prior art.

The stream of hot conditioning fluid for the conditioning step of the coking process is taken from a fractionator 36 which receives hydrocarbon fluids from the overhead of the coke drums A, B and C through the delivery line 30. Fluid products are taken from the fractionator 36 at different points through a plurality of takeoff lines. For example, naphtha can be taken from the fractionator overhead through a line 38 and a condenser 39 and passed through a reflux drum 40 from which a portion of the naphtha is fed by a pump 42 back to the fractionator 36 as reflux, while another portion of the naphtha is delivered through a line 44 to, for example, equipment for further processing. In addition, light coker gas oil can be taken off through a line 46 and heavy coker gas oil can be taken off through a line 48.

In addition, the fractionator bottoms are removed through a line 50 which directs the bottoms to the heater surge drum 12, where the bottoms mix with the fresh feed from the fresh feed line 11 and the mixture is moved by the pump 13 to the heater 14. Each of the lines removing fluid from the fractionator 36 is connected by a recirculating line controlled by a valve for recirculating one or more of the hydrocarbon fluids from the fractionator 36 to the conditioning feed line 22 through a preheater 52 placed in the line to raise the temperature of the fluid or combination of fluids to the temperature range of more than 750° F. and less than 1000° F. for conditioning the coke in the coke drums. A recirculation line 54 controlled by a valve 56 connects the line 44 to the conditioning feed line 22 to allow the recirculation of naphtha; a recirculation line 58 controlled by a valve 60 connects the light coker gas oil takeoff line 46 to the conditioning feed line 22; a recirculation line 62 controlled by a valve 64 connects the heavy coker gas oil takeoff line 48 to the conditioning feed line 22; and a recirculation line 66 controlled by a valve 68 connects the fractionator bottoms removal line 50 to the conditioning feed line 22.

The naphtha has a typical initial boiling point of at least 70° F. and a boiling point range up to, for example, 350° F. The boiling points of the other streams, light coker gas oil, heavy coker gas oil and fractionator bottoms, are all higher than the boiling point range of naphtha. The light coker gas oil can have an initial boiling point of, for example, 350° F. to 450° F., and the heavy coker gas oil can have an initial boiling point of, for example, 650° F. to 700° F. Other hydrocarbon fluid streams not specifically mentioned can be taken off from the fractionator 36 and recirculated to the coke drums A, B and C as conditioning fluid. For example, kerosene can be used and can have a boiling point range of about 350° F. to 500° F. Any one of the streams or any combination of the streams can be recirculated to the conditioning feed line 22 by opening the appropriate valves 56, 60, 64 and 68.

The invention may be embodied in other specific forms without departing from its spirit or essential characteristics. The present embodiments are, therefore, to be considered in all respects as illustrative and not restrictive, the scope of the invention being indicated by the claims rather than by the foregoing description and all changes which come within the meaning and range of the equivalents of the claims are therefore intended to be embraced therein.

We claim:

1. A delayed coking process for producing conditioned anisotropic coke comprising the steps of:

forming coke in a first of a plurality of coke drums including feeding coke feedstock to the first drum at an elevated temperature;

conditioning the coke in the first drum at an elevated temperature to lower its volatile matter content and increase its hardness and crystallinity;

decoking the first drum;

forming coke in a second of said coke drums, including feeding coke feedstock to the second drum at an elevated temperature, during the conditioning of the coke in the first drum;

conditioning the coke in the second drum at an elevated temperature to lower its volatile matter content and increase its hardness and crystallinity during the decoking of the first drum;

decoking the second drum;

forming coke in a third of said coke drums, including feeding coke feedstock to the third drum at an elevated temperature, during the conditioning of the coke in the second drum;

conditioning the coke in the third drum at an elevated temperature to lower its volatile matter content and increase its hardness and crystallinity during the decoking of the second drum; and decoking the third drum, wherein each step of conditioning the coke at an elevated temperature comprises flowing through the coke a conditioning fluid having a temperature of more than 750° F. and less than 1000° F.

2. The process of claim 1 wherein the steps in the first drum of forming coke, conditioning the coke at an elevated temperature, and decoking are simultaneous, respectively, with the steps in the third drum of conditioning the coke at an elevated temperature, decoking, and forming the coke.

3. The process of claim 1 wherein the conditioning fluid comprises hydrocarbon material having a boiling point greater than 70° F.

4. In a delayed coking process for producing conditioned anisotropic coke including passing vapors from the overhead of a coke drum to a fractionator and withdrawing from said fractionator at least one hot stream of hydrocarbon material, the improvement comprising:

forming coke in a first of plurality of coke drums including feeding coke feedstock to the first drum at an elevated temperature;

conditioning the coke in the first drum at an elevated temperature to lower its volatile matter content and increase its hardness and crystallinity;

decoking the first drum;

forming coke in a second of said coke drums, including feeding coke feedstock to the second drum at an elevated temperature, during the conditioning of the coke in the first drum;

conditioning the coke in the second drum at an elevated temperature to lower its volatile matter content and increase its hardness and crystallinity during the decoking of the first drum;

decoking the second drum;

forming coke in a third of said coke drums, including feeding coke feedstock to the third drum at an elevated temperature, during the conditioning of the coke in the second drum;

conditioning the coke in the third drum at an elevated temperature to lower its volatile matter content and increase its hardness and crystallinity during the decoking of the second drum; and decoking the third drum, wherein each step of conditioning the coke at an elevated temperature comprises flowing through the coke at least one of said at least one hot stream of hydrocarbon material withdrawn from said fractionator and having a temperature greater than 750° F. and less than 1000° F.

5. The process of claim 4 wherein said hydrocarbon material comprises hydrocarbon material having a boiling point greater than 70° F.

6. The process of claim 4 wherein the hydrocarbon material includes at least one of naphtha, light coker gas oil, heavy coker gas oil and fractionator bottoms recycle.

7. The process of claim 4 wherein the hydrocarbon material has a boiling point greater than 70° F.

8. The process of claim 4 wherein said hot stream is heated prior to flowing through the coke.

* * * * *